United States Patent [19]

Ikushima et al.

[11] Patent Number: 4,599,119

[45] Date of Patent: Jul. 8, 1986

[54] AGE-HARDENING COPPER TITANIUM ALLOY

[75] Inventors: Kazuo Ikushima; Yoshio Itoh; Toshiaki Ishihara, all of Nagoya, Japan

[73] Assignee: NGK Insulators, Ltd., Japan

[21] Appl. No.: 671,010

[22] Filed: Nov. 13, 1984

[30] Foreign Application Priority Data

Nov. 22, 1983 [JP] Japan ..... 58-220138

[51] Int. Cl.[4] ..... C22C 9/01

[52] U.S. Cl. ..... 148/411; 148/11.5 C; 148/12.7 C; 420/492

[58] Field of Search ..... 420/492; 148/11.5 C, 148/12.7 C, 411

[56] References Cited

U.S. PATENT DOCUMENTS

| | | | |
|---|---|---|---|
| 2,943,960 | 7/1960 | Saarivirta | 148/12.7 C |
| 4,110,132 | 8/1978 | Parikh et al. | 148/11.5 C |
| 4,260,432 | 4/1981 | Plewes | 148/12.7 C |
| 4,425,168 | 1/1984 | Goldstein et al. | 148/2 |

OTHER PUBLICATIONS

Mendenhall, *Understanding Copper Alloys,* Olin Corporation, East Alton, Illinois, 1977, p. 157.

Dutkiewicz, "Electron Microscope Study of the Effect of Deformation on Precipitation and Recrystallization in Copper-Titanium Alloys", Metallurgical Transactions A, vol. 8A, May 1977, pp. 751-761.

Piotrowski et al., "Influence of Vanadium on Structure and Kinetic Transformations in Cu-Ti Alloys", Metals Technology, Dec. 1980, pp. 502-508.

*Primary Examiner*—Veronica O'Keefe

*Attorney, Agent, or Firm*—Parkhurst & Oliff

[57] ABSTRACT

An age-hardening copper titanium alloy containing 2 to 6% by weight of titanium, and composed of a substantially fully solution heat-treated structure having an average crystal grain size not exceeding 25 microns. When the alloy is cold-rolled after its solution heat treatment, its elongation in the rolling direction and that in a direction perpendicular thereto have a difference of within 20% therebetween, and its bend radius to thickness ratios in those two directions are substantially equal to each other.

6 Claims, No Drawings

AGE-HARDENING COPPER TITANIUM ALLOY

BACKGROUND OF THE INVENTION

1. Field of the Invention

This invention relates to an age-hardened copper titanium alloy having improved properties.

2. Description of the Prior Art

A lot of electrically conductive springs of thin plate type are made of an age-hardened copper titanium alloy because of its excellent mechanical strength and electrical conductivity. Such spring sheets are usually produced by a process which includes preparing a copper titanium melt, casting it, hot working the cast copper titanium, subjecting the hot-worked copper titanium to alternate annealing and cold working to final shape, subjecting the copper titanium to solution heat treatment, and age-hardening it after cold working, if required. Its solution heat-treated structure has, however, an average crystal grain size of at least 40 microns and even up to 100 microns.

The age-hardened copper titanium alloy has been developed as an inexpensive substitute for a well-known age-hardened copper beryllium alloy which is disclosed in, for example, U.S. Pat. No. 4,425,168 issued to Goldstein et al. on Jan. 10, 1984. The conventional age-hardened copper titanium alloy is, however, not satisfactory, and required to be improved, in view of mechanical properties such as formability, fatigue strength, elongation and yield strength. Moreover, it has the drawback of having different properties in the rolling direction and in a direction perpendicular thereto.

SUMMARY OF THE INVENTION

The inventors of the present invention have found that the properties of an age-hardened copper titanium alloy are drastically improved and have only a very narrow range of variation in properties if its structure has an average crystal grain size not exceeding a certain level.

It is, therefore, an object of this invention to provide an age-hardened copper titanium alloy having drastically improved and stabilized properties.

This is attained by age-hardening a copper titanium alloy which is subjected to a substantially full degree of solution heat treatment and thereby given a structure having an average crystal grain size not exceeding 25 microns.

The properties of the alloy of this invention, such as formability, fatigue strength, elongation and yield strength, are greatly improved and have a high degree of uniformity. For example, the cold rolling of the alloy after solution heat treatment does not make any appreciable anisotropy between the rolling direction and the direction perpendicular thereto.

Furthermore, the alloy contains 2 to 6% by weight of titanium.

DETAILED DESCRIPTION OF THE INVENTION

The copper titanium alloy of this invention is characterized by a structure having an average crystal grain size not exceeding 25 microns. This limitation is necessary to improve the formability, fatigue strength, elongation and other properties of the alloy drastically, as compared with those of the conventional age-hardened copper titanium alloy having an average crystal grain size of 40 microns or more. An average crystal grain size exceeding 25 microns does not give the alloy any substantially improved properties, and its properties have a wide range of variation. In order to attain the object of this invention most effectively, it is preferable to control the average crystal grain size of the alloy at a level not exceeding 15 microns. The lower limit to the average crystal grain size of the alloy depends on the level of production technology, but may usually be about two microns.

The alloy of this invention is a copper-based alloy consisting mainly of copper and containing 2 to 6% by weight of titanium. It preferably contains 3 to 5% by weight of titanium. If it contains less than 2% by weight of titanium, no appreciable effect of age-hardening can be expected, and the addition of more than 6% by weight of titanium does not provide a correspondingly improved effect of age-hardening as the excess over 6% is increased. This invention is also applicable to other copper alloys containing at least one of other elements, such as Fe, Zr, Cr, B and Si, in addition to 2 to 6% by weight of titanium. Such other element(s) is (are) generally contained up to 2.0% by weight in a total amount.

A preferred process for producing the alloy of this invention will now be described. A copper titanium melt of the composition satisfying the requirements of this invention is prepared and cast to form an ingot by known methods. The ingot is hot-forged or hot-rolled, and if required, the hot-worked product is subjected to cold working, such as cold rolling, as practiced in the art.

The hot-worked or cold-worked material is subjected to an intermediate annealing at a temperature which is lower than a solid solution-forming temperature and a recrystallization temperature. In other words, intermediate annealing is effected at a temperature lower than ordinary annealing in order to achieve the fine and uniform distribution and precipitation of a secondary phase in a master or matrix phase. The term "master or matrix phase" as herein used means the $\alpha$-phase in a binary phase diagram for a copper titanium alloy, and the "secondary phase" means the precipitate of an intermetallic compound expressed as $Cu_3Ti$. The "solid solution-forming temperature" is a temperature defining the boundary between the "$\alpha+Cu_3Ti$" phase and the $\alpha$-phase.

The use for intermediate annealing of a temperature which is lower than both the solid solution-forming and recrystallization temperatures is important for the precipitation of a fine and uniformly distributed secondary phase in the master phase. If the annealing temperature exceeds the solid solution-forming temperature, no secondary phase is precipitated in the master phase. If it is lower than the solid solution-forming temperature, but exceeds the recrystallization temperature, it is impossible to obtain a fine, uniformly distributed secondary phase, since the growth of crystal grains starts in the master phase and reduces the amount of the precipitate and results in a coarse secondary phase.

The fine and uniform secondary phase formed by the intermediate annealing in the master phase contributes to avoiding the coarsening of crystal grains in the master phase during the final solution heat treatment of the alloy and thereby developing a desired solution heat treated structure having an average crystal grain size not exceeding 25 microns. If an alloy having a secondary phase which is not finely and uniformly distributed in the master phase is subjected to solution heat treatment, the crystal grains in the master phase lose uniformity in size and become coarse.

The specific temperature and time for intermediate annealing of the copper titanium alloy depend on various factors, such as the titanium content of the alloy and the method employed for working it, and are therefore difficult to set forth in a definite fashion. It is, however, generally suitable to hold the alloy at a temperature of 500° C. to 700° C. for a period of time of one to 20 hours.

The alloy is then subjected to solution heat treatment after it has been cold-worked, or without being cold-worked. The fine and uniform secondary phase in the master phase contributes to avoiding effectively the coarsening of crystal grains in the master phase during the heating of the alloy for its solution heat treatment, and contributes to quick formation of a uniform solid solution in the master phase at a solution heat treatment temperature which is higher than the solid solution-forming and recrystallization temperatures. It is sufficient to hold the alloy at that temperature for a very short period of time as compared with the solution heat treatment for the conventional age-hardened copper titanium alloy. The secondary phase forms a desired solid solution in the master phase without causing any coarsening of crystal grains. According to the present invention, therefore, it is easy to obtain a copper titanium alloy characterized by a solution heat-treated structure having an average crystal grain size not exceeding 25 microns.

This solution heat treatment is performed for a period of time ending immediately after or before the secondary phase forms a complete solid solution in the master phase. This period of time depends on various factors, such as the chemical composition, thickness or size of the alloy, the size of the secondary phase and the working done for the alloy. If the alloy is, for example, in the form of a sheet having a small thickness, it is up to three minutes, but if it has a large thickness, it may range from 30 minutes to an hour, depending on its thickness.

The solution heat-treated alloy is subjected to ordinary age-hardening at a temperature of 300° C. to 500° C. for a period of time of 30 minutes to three hours after it has been cold-rolled or otherwise worked as required.

The solution heat-treated structure having an average crystal grain size not exceeding 25 microns gives the alloy drastically improved formability, fatigue strength, elongation and yield strength. Neither the cold rolling of the solution heat-treated alloy nor the cold rolling and age-hardening thereof develops any substantial difference (anistropy) between its properties in the rolling direction and those in a direction perpendicular thereto.

Only a difference of within 20% exists between the elongation of the alloy in the rolling direction and that in the direction perpendicular thereto, and only a difference of within 50% exists between its 90° bend formability in the rolling direction and that in the direction perpendicular thereto. The alloy of this invention is, thus, a very useful material which is practically free from any directionality.

The invention will now be described more specifically with reference to several examples which are merely illustrative of this invention and are not intended to limit its scope.

EXAMPLE 1

A copper titanium alloy containing 4.0% by weight of titanium, the balance being copper and inevitable impurities, was melted, cast and hot-forged and hot-rolled to a thickness of 1.2 mm by a customary process. It was, then, held at a temperature of 800° C. for 10 minutes, water-cooled and cold-rolled to a thickness of 0.5 mm.

The cold-rolled material was subjected to intermediate annealing at a temperature of 650° C. for eight hours to provide an annealed material having a structure characterized by a spherical secondary phase existing in a large quantity and distributed finely and uniformly in the master phase. The annealed material was held at a temperature of 830° C. for five seconds and water-cooled for its final solution heat treatment, whereby there was obtained a copper titanium alloy strip having a uniform solution heat-treated structure characterized by a secondary phase which had formed a full solid solution in the master phase, and an average crystal grain size of 10 microns.

For comparison purposes, another cold-rolled material having a thickness of 0.5 mm and prepared in the manner as herein-above described was subjected to final solution heat treatment at 830° C. without being subjected to intermediate annealing at 650° C. This material required a period of three minutes to obtain a practically satisfactory solution heat-treated structure having a secondary phase which had formed a full solid solution in the master phase. The material which had been subjected to three minutes of solution heat treatment and water-cooled was found to have an average crystal grain size of 40 microns in the master phase.

The two strips were each cold-rolled at a reduction ratio of 40% to form an H-condition material having a thickness of 0.3 mm. The H-condition materials were each age-hardened at a temperature of 400° C. for two hours to form an HT-condition material. The H-condition and HT-condition materials were tested for hardness, tensile strength, 0.2% yield strength, elongation and 90° bend formability (a ratio of 90° bend radius to thickness). The results are shown in TABLES 1 and 2.

As is obvious from TABLES 1 and 2, the copper titanium alloy strip of this invention characterized by a structure having an average crystal grain size of 10 microns was superior to the comparative strip having an average crystal grain size of 40 microns in tensile strength, 0.2% yield strength, elongation and bend formability, despite their substantially equal hardness. It is also obvious from TABLES 1 and 2 that the strip of this invention showed only a very small difference between its physical properties in the rolling direction (0°) and those in the direction perpendicular thereto (90°), as compared with the comparable strip. It is a very small difference which is negligible, and which shows that the material of this invention has uniform properties which are practically free from any directionality.

TABLE 1

| Average Crystal Grain Size (microns) | Hardness (Hv) | Tensile Strength (kgf/mm²) | | Elongation (%) | | 90° Bend Formability (bend radius thickness) | |
|---|---|---|---|---|---|---|---|
| | | 0° | 90° | 0° | 90° | 0° | 90° |
| 10 | 246 | 81.1 | 79.5 | 2.5 | 2.7 | 0.5 | 0.5 |
| 40 | 248 | 76.7 | 71.9 | 1.6 | 2.4 | 2 | 4 |

TABLE 2

| Average Crystal Grain Size (microns) | Hardness (Hv) | Tensile Strength (kgf/mm²) 0° | Tensile Strength (kgf/mm²) 90° | 0.2% Yield Strength (kgf/mm²) 0° | 0.2% Yield Strength (kgf/mm²) 90° | Elongation (%) 0° | Elongation (%) 90° |
|---|---|---|---|---|---|---|---|
| 10 | 337 | 106.8 | 107.3 | 97.4 | 95.8 | 18.9 | 19.7 |
| 40 | 340 | 105.5 | 98.2 | 94.3 | 85.9 | 12.3 | 17.1 |

EXAMPLE 2

Eight sample copper titanium strips having a thickness of 0.3 mm and composed of a structure having different average crystal grain sizes and containing a secondary phase which had formed a microscopically satisfatory solid solution were produced by intermediate annealing, cold working at a reduction rate of 40% and final solution heat treatment from cold-rolled materials prepared as set forth in EXAMPLE 1 and having a thickness of 0.5 mm. The conditions for intermediate annealing and final solution heat treatment were varied as shown in TABLE 3.

TABLE 3

| Sample No. | Intermediate Annealing | Final Solution Heat Treatment | Average Crystal Grain Size (μm) |
|---|---|---|---|
| 1 | 600° C., 12 hr. | 830° C., 3 sec. | 3 |
| 2 | 600° C., 12 hr. | 830° C., 5 sec. | 5 |
| 3 | 550° C., 12 hr. | 830° C., 5 sec. | 10 |
| 4 | 650° C., 8 hr. | 830° C., 5 sec. | 15 |
| 5 | 500° C., 20 hr. | 830° C., 10 sec. | 21 |
| 6 | 650° C., 8 hr. | 830° C., 20 sec. | 28 |
| 7 | 700° C., 1 hr. | 830° C., 20 sec. | 30 |
| 8 | 800° C., 3 min. and water cool | 830° C., 2 min. | 40 |

Each strip was, then, cold-worked to a thickness of 0.15 mm and age-hardened at a temperature of 400° C. for two hours. The cold-worked and age-hardened strips were tested for mechanical properties. The results are shown in TABLE 4. The cold-working and age-hardening did not have any substantial effect on the average crystal grain size of any samle strip.

TABLE 4

| Average Crystal Grain Size (microns) | Hardness (Hv) | Tensile Strength (kgf/mm²) 0° | Tensile Strength (kgf/mm²) 90° | 0.2% Yield Strength (kgf/mm²) 0° | 0.2% Yield Strength (kgf/mm²) 90° | Elongation (%) 0° | Elongation (%) 90° | 90° Bend Formability (bend radius/thickness) 0° | 90° Bend Formability (bend radius/thickness) 90° |
|---|---|---|---|---|---|---|---|---|---|
| 3 | 331 | 101.3 | 101.1 | 94.1 | 94.0 | 11.1 | 11.1 | 0.5 | 0.5 |
| 5 | 333 | 109.1 | 109.2 | 97.3 | 97.1 | 10.6 | 10.8 | 0.5 | 0.5 |
| 10 | 335 | 109.8 | 109.5 | 98.7 | 98.4 | 9.1 | 9.1 | 0.5 | 0.5 |
| 15 | 337 | 110.5 | 110.1 | 97.5 | 97.0 | 7.1 | 7.3 | 1 | 1 |
| 21 | 336 | 108.3 | 108.8 | 93.4 | 92.7 | 6.0 | 6.1 | 1 | 1 |
| 28 | 338 | 105.3 | 99.9 | 89.9 | 84.2 | 2.9 | 3.5 | 2 | 3 |
| 30 | 340 | 102.3 | 96.8 | 87.3 | 83.8 | 2.1 | 3.1 | 2 | 4 |
| 40 | 339 | 101.9 | 96.1 | 87.1 | 81.9 | 2.0 | 2.9 | 2 | 4 |

As is obvious from TABLE 4, the age-hardened strips showed a substantially equal or improved tensile strength, and improved 0.2% yield strength, elongation and 90° bend formability with a reduction in average crystal grain size, though their hardness was substantially equal or showed a slight reduction with a reduction in average crystal grain size. These results were particularly remarkable with the material composed of a solution heat-treated structure having an average crystal grain size not exceeding 25 microns. It is also obvious from TABLE 4 that the properties of the material in the rolling direction and those in the direction perpendicular thereto showed a decreasing difference therebetween with a reduction in average crystal grain size, and that substantially no such difference existed in the material composed of a solution heat-treated structure having an average crystal grain size not exceeding 10 microns.

What is claimed is:

1. An age-hardened copper titanium alloy comprising a substantially fully solution heat-treated structure including 2 to 6% by weight of titanium and the remainder being copper, and having an average crystal grain size of not greater than 25 microns, said copper titanium alloy being produced by casting a copper titanium alloy melt, working the cast alloy at least in a hot condition, annealing the worked alloy, and subjecting the annealed alloy to a solution heat treatment, said annealing occurring at a temperature of 500° C. to 700° C. for a time period of one to twenty hours, wherein elongation of said alloy in a rolling direction as compared with elongation in a direction perpendicular to said rolling direction having a difference of within 20%, and a bend formability of said alloy in said rolling direction as compared with a bend formability in said perpendicular direction are substantially equal to each other.

2. The alloy as set forth in claim 1, wherein said alloy contains 3 to 5% by weight of titanium.

3. The alloy as set forth in claim 1, wherein said average crystal grain size is 3 microns to 15 microns.

4. The alloy as set forth in claim 1, wherein said alloy further includes at least one element selected from the group consisting of iron, zirconium, chromium, boron and silicon, in addition to said titanium, the remainder consisting essentially of copper.

5. An age-hardened copper titanium alloy comprising a substantially fully solution heat-treated structure including 2 to 6% by weight of titanium and at least one element selected from the group consisting of iron, zirconium, chromium, boron and silicon and the remainder consisting essentially of copper, said copper titanium alloy having an average crystal grain size of not greater than 25 microns, and being produced by casting a copper titanium alloy melt, working the cast alloy at least in a hot condition, annealing the worked alloy, and subjecting the annealed alloy to a solution heat treatment, said annealing occurring at a temperature of 500° C. to 700° C. for a time period of one to twenty hours.

6. The alloy as set forth in claim 5, wherein said iron, zirconium, chromium, boron and silicon do not exceed 2% by weight in a total amount.

* * * * *